US012281876B2

(12) United States Patent
Dardzinski et al.

(10) Patent No.: US 12,281,876 B2
(45) Date of Patent: Apr. 22, 2025

(54) MODULAR FIREARM SIGHT MOUNTING SYSTEM

(71) Applicant: Troy Industries, Inc., Clarksville, TN (US)

(72) Inventors: Brett Dardzinski, Clarksville, TN (US); Christian Brekken, Clarksville, TN (US); Cory Halbrooks, Clarksville, TN (US)

(73) Assignee: Troy Industries, Inc., Clarksville, TN (US)

( * ) Notice: Subject to any disclaimer, the term of this patent is extended or adjusted under 35 U.S.C. 154(b) by 92 days.

(21) Appl. No.: 18/068,381

(22) Filed: Dec. 19, 2022

(65) Prior Publication Data

US 2023/0194212 A1 Jun. 22, 2023

Related U.S. Application Data

(60) Provisional application No. 63/291,532, filed on Dec. 20, 2021.

(51) Int. Cl.
*F41G 11/00* (2006.01)
*F41G 1/30* (2006.01)

(52) U.S. Cl.
CPC ..... *F41G 11/003* (2013.01); *F41G 1/30* (2013.01)

(58) Field of Classification Search
CPC ..... F41G 11/003; F41G 1/30
See application file for complete search history.

(56) References Cited

U.S. PATENT DOCUMENTS 2,450,466 A * 10/1948 Carlson ..... F41G 11/001 248/506
2,510,289 A * 6/1950 Livermore ..... F41G 11/002 42/127
2,621,410 A * 12/1952 Street ..... F41G 11/002 42/126
2,836,895 A * 6/1958 Dillon ..... F41G 11/007 42/127
4,026,054 A * 5/1977 Snyder ..... F41G 11/002 362/110
4,027,414 A * 6/1977 Felix ..... F41G 11/002 42/127
6,449,893 B2 * 9/2002 Spinner ..... F41G 11/001 42/126
6,678,988 B1 * 1/2004 Poff, Jr. ..... F41G 11/003 42/147
7,954,270 B2 * 6/2011 Bentley ..... F41G 11/003 42/72
8,205,375 B1 * 6/2012 Swan ..... F41G 1/38 42/124
8,347,544 B1 * 1/2013 Swan ..... F41G 1/38 42/124

(Continued)

*Primary Examiner* — Michelle Clement

(57) ABSTRACT

A mounting system securing a firearm sight to a firearm accessory rail includes a clamp with a downwardly open rail cavity for slidably engaging the rail. The sight is matched to a plate with pins that correspond to the sockets on the bottom of the sight, and the plate has sockets that correspond to pins on a base that contacts the rail. The clamp extends through the base and plate allowing the sight to be secured to the clamp. Securing the sigh to the clamp compresses the base, plate, and sight toward the rail, placing the system in tension to hold the sight to the firearm.

10 Claims, 14 Drawing Sheets

(56) References Cited

U.S. PATENT DOCUMENTS

| | | | | |
|---|---|---|---|---|
| 8,806,799 | B1 * | 8/2014 | Gordon | F41G 1/01 42/130 |
| 10,048,040 | B1 * | 8/2018 | Ratliff | F41G 11/001 |
| 10,352,658 | B1 * | 7/2019 | Aslin | F41G 11/003 |
| 10,365,069 | B1 * | 7/2019 | Tayon | F41G 11/003 |
| 10,724,569 | B2 * | 7/2020 | Windfeldt | F16B 33/02 |
| 10,942,009 | B2 * | 3/2021 | Galli | F41G 1/35 |
| 11,029,131 | B2 * | 6/2021 | Cahill | F41G 11/003 |
| 11,143,361 | B2 * | 10/2021 | Chen | F16B 2/065 |
| 11,150,049 | B2 * | 10/2021 | Kennair, Jr. | F41G 11/003 |
| 11,306,999 | B2 * | 4/2022 | Ma | F41G 1/387 |
| 11,391,544 | B2 * | 7/2022 | Pigott | G01S 17/48 |
| 11,988,485 | B2 * | 5/2024 | Caffey | F41C 27/00 |
| 12,000,673 | B2 * | 6/2024 | Zimmer | F41G 11/001 |
| 2021/0333068 | A1 * | 10/2021 | Lindsay | F41G 11/003 |
| 2022/0282956 | A1 * | 9/2022 | Yan | F41G 11/003 |
| 2022/0357127 | A1 * | 11/2022 | Sun | G02B 27/20 |
| 2024/0093967 | A1 * | 3/2024 | Karagias | F41G 11/001 |

* cited by examiner

MODULAR FIREARM SIGHT MOUNTING SYSTEM

CROSS-REFERENCE TO RELATED APPLICATIONS

This application claims priority in U.S. Provisional Patent Application No. 63/291,532, filed Dec. 20, 2021, the contents of which are hereby incorporated by reference.

BACKGROUND

1. Field of the Disclosed Subject Matter

Firearm accessory rail system attachments.

2. Background

Firearm sight systems allow a user to aim the firearm at a target. Third-party sight systems present different mounting requirements for the user, and how they are mounted to firearms. Some sight systems use lenses to produce a red dot indicator viewed by the user for aiming the firearm.

Third-party sight systems require the user to use proprietary mounting systems, in turn, increasing the complexity of using various third-party sight systems with a firearm, and making the exchange of such third-party sight systems time consuming.

SUMMARY

The disclosed firearm sight mounting system allows a user to install third-party sight systems to a firearm accessory rail, and allows quick exchange of third-party firearm sights for firearms using firearm accessory rails systems, or similar attachment points.

The mounting system for securing a firearm sight to a firearm accessory rail where the rail has a lower surface, provides a clamp forming a lower portion, where the lower portion forms a downwardly open polygonal rail cavity. The firearm sight is secured to the clamp, thereby engaging the rail cavity with the lower surface of the rail. The clamp forms an upper portion extending from a lower portion, and the sight is secured to the upper portion. The system may be used with a base positioned between the firearm sight and the rail, with the clamp upper portion extending through the base. The system may be further used with a plate positioned between the firearm sight and the base, with the clamp upper portion extending through the base. The system may utilize several different plates, each adapted for use with various firearm sights, allowing a user to employ the clamp and base with a firearm, and allow the user to interchangeably use various plate and firearm sight combinations as desired.

The mounting system also provides plates with pins for engaging sockets on the bottom of firearm sights for securing the alignment of these components. Additionally, the system also provides the base with pins for engaging sockets on the bottom of the plate for securing the alignment of these components.

These and other features, aspects, and advantages of the present disclosed subject matter will become more understood with reference to the following description and appended claims.

BRIEF DESCRIPTION OF THE DRAWINGS

The present disclosed subject matter is described herein with reference to the following drawing figures, with greater emphasis being placed on clarity rather than scale.

DETAILED DESCRIPTION

Figure 1:
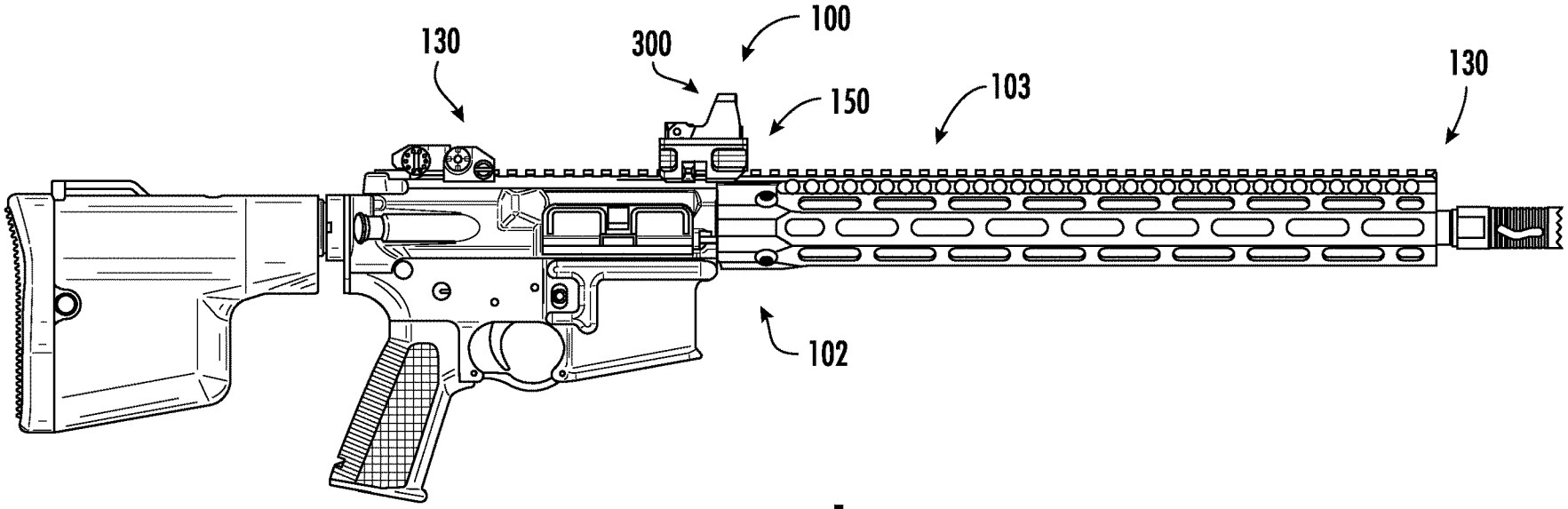
FIG. 1 is an elevation view of a modular firearm sight mounting system attached to a firearm embodying principles of the disclosed subject matter.
Figure 2:
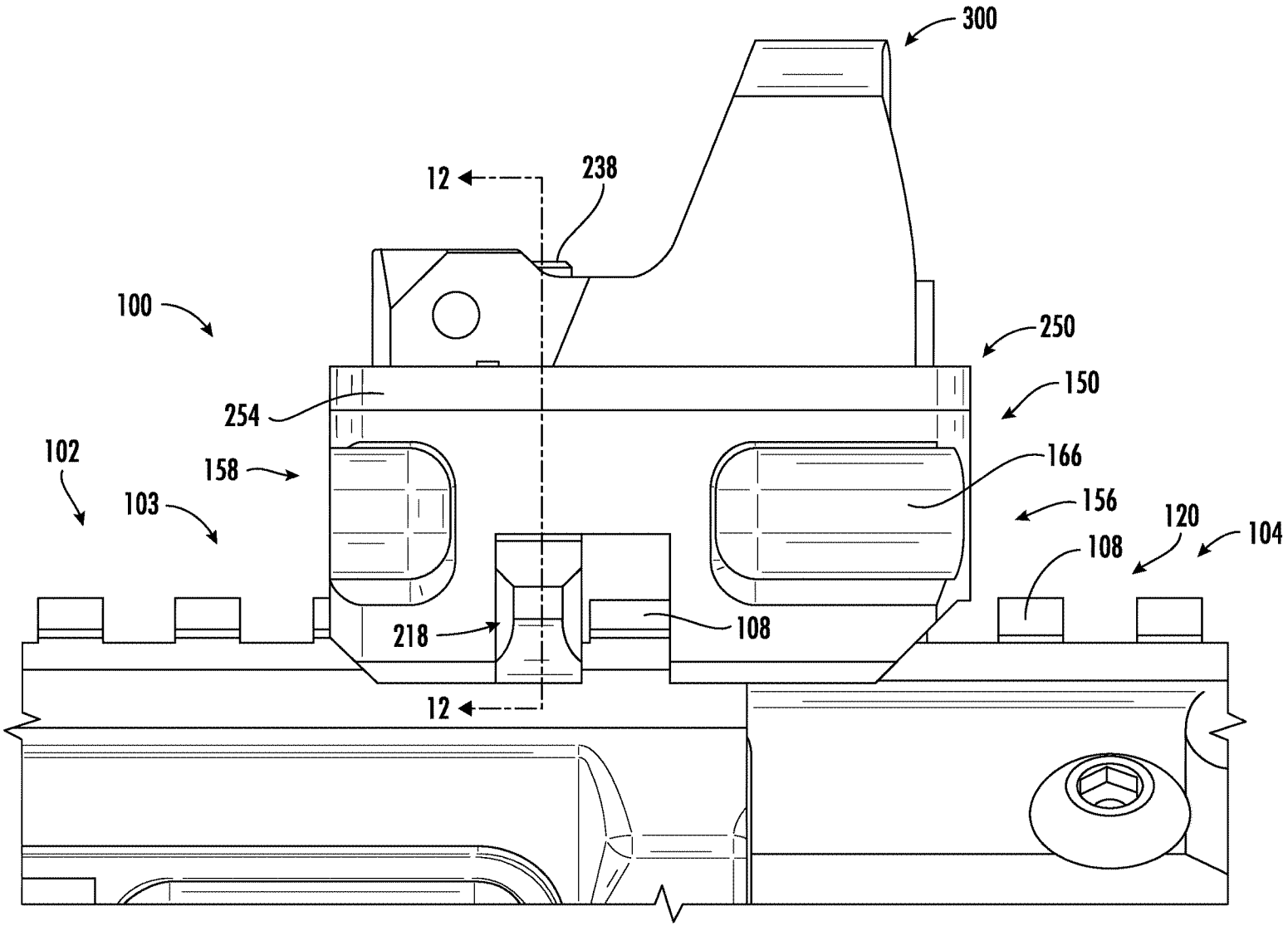
FIG. 2 is an enlarged view of FIG. 1.

Referring to the drawings, a mount system 100 is shown and described. The system 100 (FIG. 3) includes a base 150 used with a clamp 200 and an adapter plate 250 to attach a firearm sight 300 to a rail 103 attached to a firearm 102 (FIG. 1). The adapter plate 250 may be formed with an arrangement of pins 252 that register with an arrangement of sockets 306 found on the bottom of various types of sights 300 sold commercially, to position the sight on the base 150. The clamp 200 engages the rail 103, and extends through a passage 154 in the base 150 and a passage 256 in the adapter plate 250. The sight 300 is mounted to the clamp 200 and secured to the rail 103 by the clamp 200. The base 150 provides an interface for mounting the sight 300 to a firearm 102, and stabilizes the sight 300 on the rail 103. The location of the pins 252 on an adapter plate 250 can be arranged to accommodate the location of sockets 306 on the bottom of the sight 300 of various manufacturers, allowing a user to have various plates specific to each type of sight, thereby allowing the user to mount sights of various manufactures to a firearm with a rail 103 using the base 150 and clamp 200 without the need to have a unique mount system for each sight. Securing the sight 300 to the clamp 200 pulls the sight 300, adapter plate 250, and base 150 toward the rail 103, causing the system 100 to be in tension, thereby securing the sight 300 and mount system 100 to the firearm 102, creating a stable platform for the sight 300. The firearm 102 can be any type of firearm utilizing a rail 103, such as a handgun or AR-15/M16 firearms.

In an implementation, the system 100 is used to attach a third-party sight 300 to a Picatinny-type rail 103. An example of a third-party sight is the Viper® Red Dot sight sold by Sheltered Wings, Inc., dba Vortex Optics, of Barneveld, Wisconsin, or the ROMEO® 1 PRO sight sold by Sig Sauer, Inc. of Newington, New Hampshire Another example is an optical sight, such as the one disclosed in U.S. Pat. No. 10,352,654, the entire disclosure of which, except for any definitions, disclaimers, disavowals, and inconsistences with the teachings explicitly set forth in this specification, is incorporated herein by reference.

Figure 13:
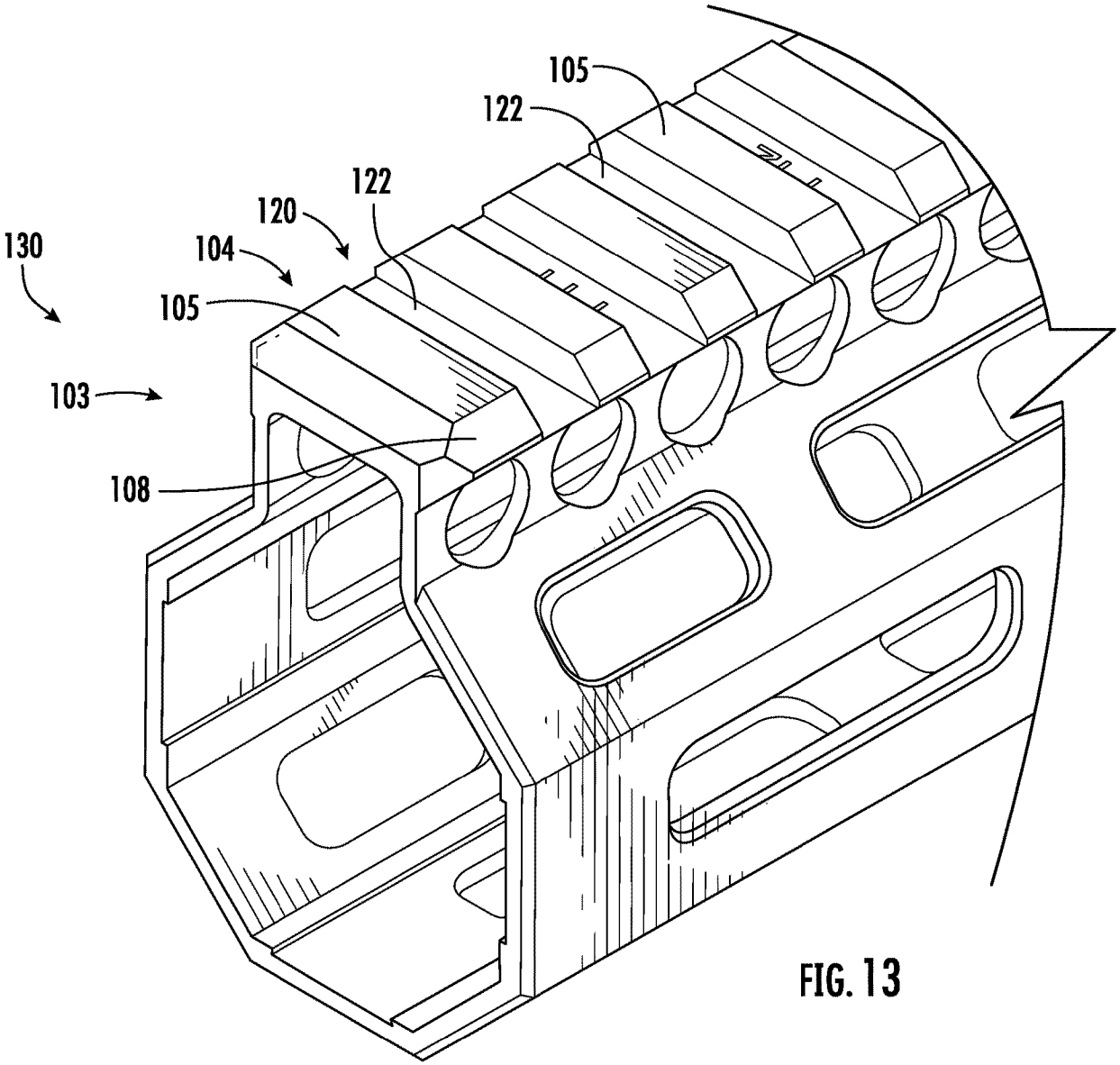
FIG. 13 is an isometric view from above of a firearm handguard with an integrated rail.
Figure 14:
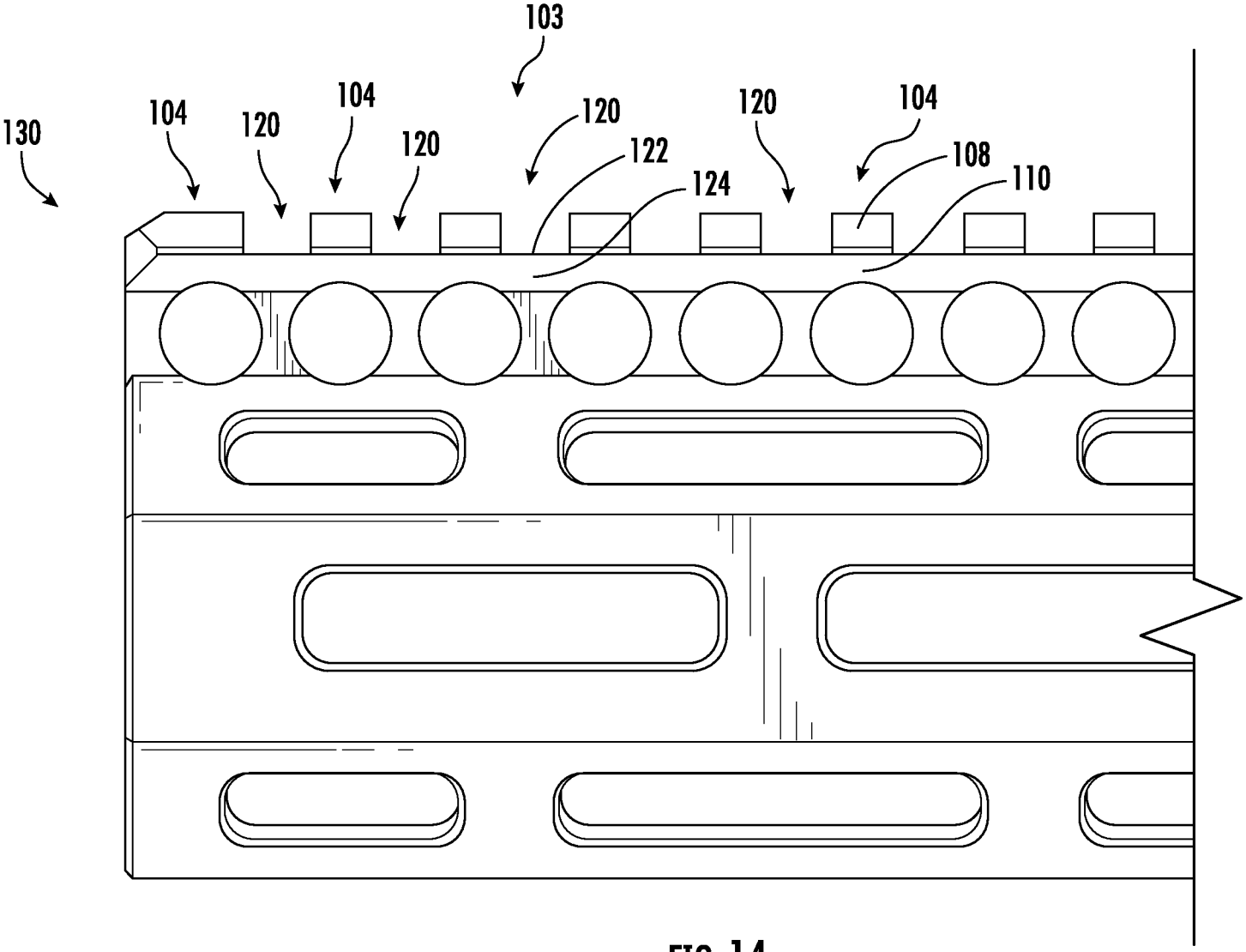
FIG. 14 is a left elevation of the handguard of FIG. 13.

The rail 103 (FIGS. 13-14) is an elongated member that extends a length of a firearm 102 parallel to the barrel, allowing the user to attach accessories to the firearm 102, such as sights 300, including red dot sights. A rail allows a user to attach accessories to a firearm, such as the one described in U.S. Pat. No. 10,330,433, the entire disclosure of which, except for any definitions, disclaimers, disavowals, and inconsistences with the teachings explicitly set forth in this specification, is incorporated herein by reference. The rail 103 includes a series of sequential, flattened T-shaped rail members 104 forming ribs or lugs separated by slots 120, with the series repeating along a length of the rail 103. Each rail member 104 has a top surface 105 and opposite left and right edges 106, 112 forming a generally polygonal shape. Left edge 106 forms an angled upper surface 108 and angled lower surface 110. Right edge 112 forms an angled upper surface 114 and angled lower surface 116. Each slot 120 has a top surface 122 located below the angled upper surfaces 108, 114, and above the angled lower surfaces 110, 116, and an angled left and right lower surface 124, 126, whereby each of the angled lower surfaces 110, 124 and 116, 126 form a continuous lower surface extending the length of the rail 103.

Figure 3:
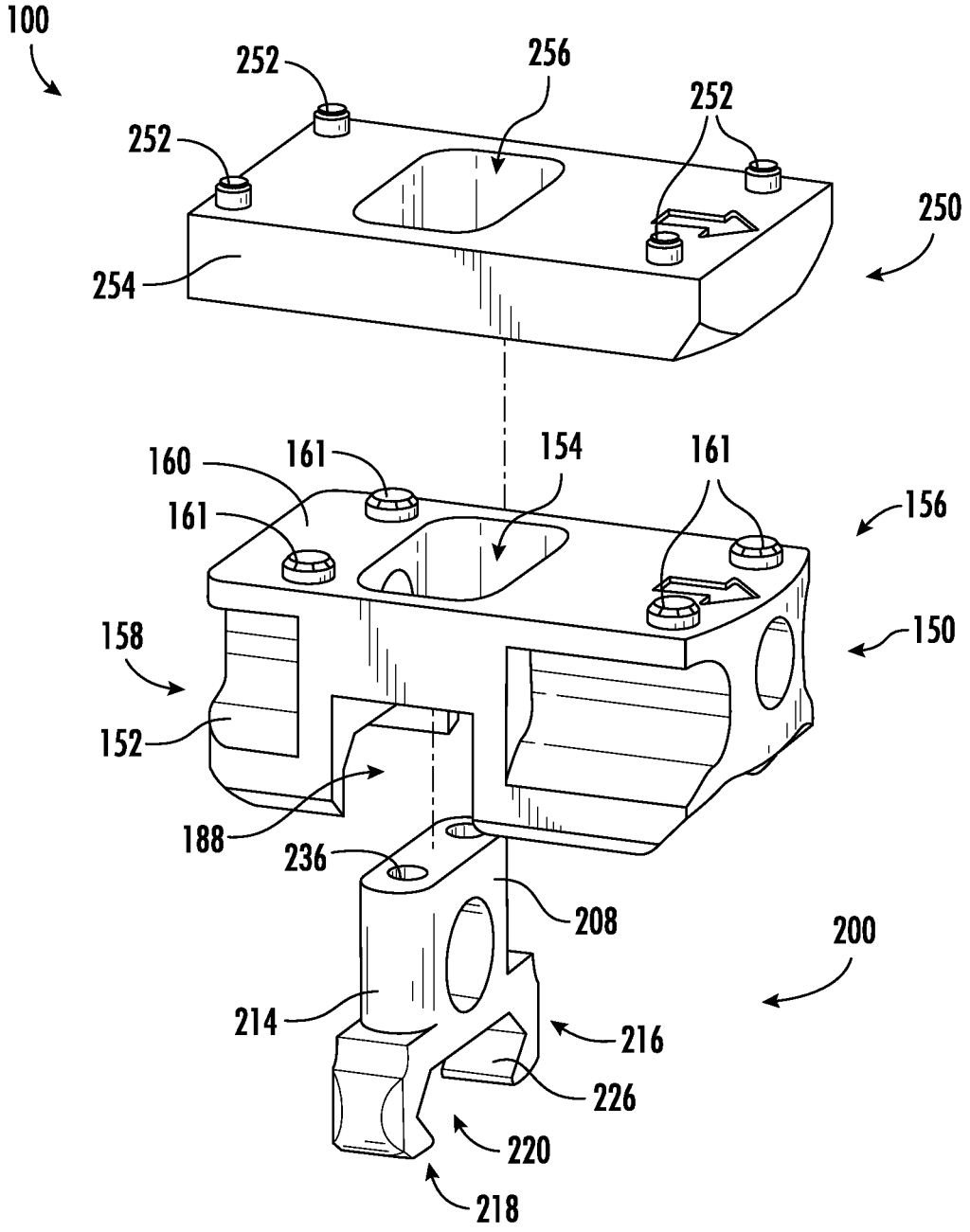
FIG. 3 is an exploded view of a modular firearm sight mounting system embodying principles of the disclosed subject matter.
Figure 4:
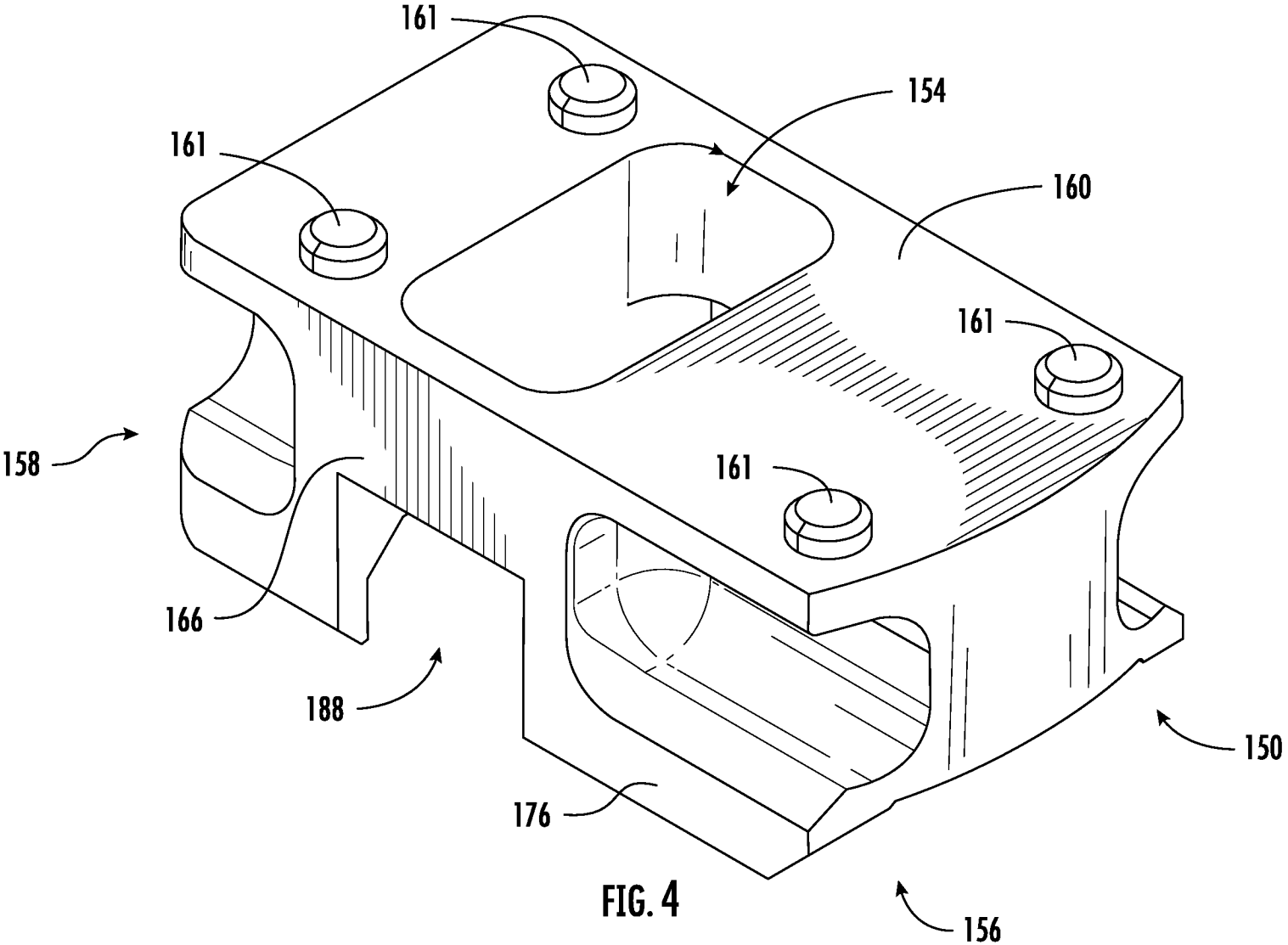
FIG. 4 is an isometric view from above of a base component of a modular firearm sight mounting system embodying principles of the disclosed subject matter.
Figure 5:
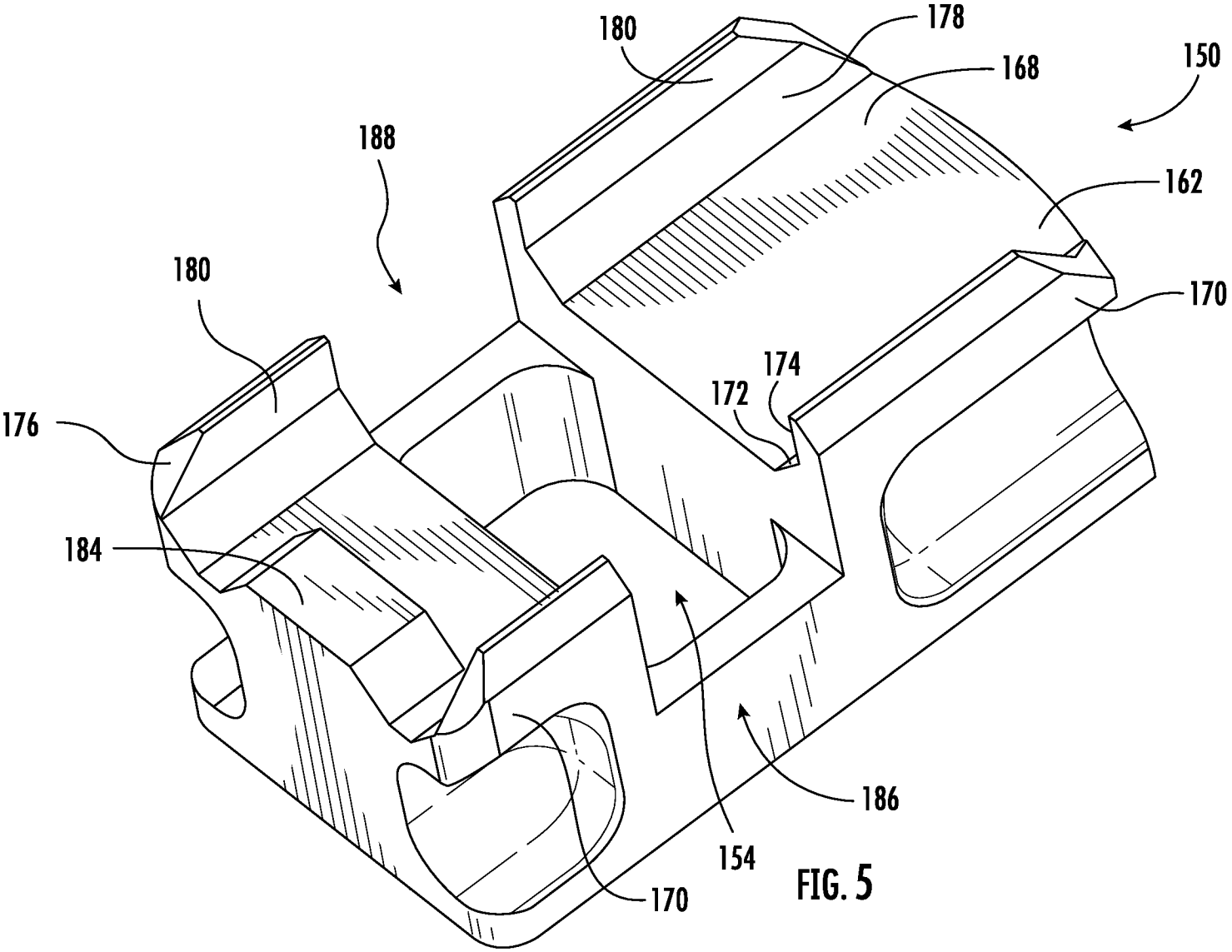
FIG. 5 is an isometric view from below of the component of FIG. 4.

Referring to FIGS. 3-5, the base 150 may comprise a one-piece, generally rectangular body 152, extending between a front portion 156 and a rear portion 158, defining a length. The body 152 has a top surface 160 presenting an upper profile, and a bottom surface 162 presenting a lower profile, defining a height, and opposing left side 164 and right side 166, defining a width. The top surface 160 forms an arrangement of pins 161 extending therefrom adapted to engage the sockets 266 of the adapter plate 250. Alternatively, the pins 161 are adapted to directly engage the sockets 306 on the underside of the sight 300, and the clamp 200 is secured to the sight 300.

In an implementation, the base 150 is manufactured from a resilient material, including metal such as 6061-T6 aluminum, or non-metal, and may be formed by casting or forming, reductive manufacturing such as milling, or additive manufacturing such as 3D printing or material deposition.

In an implementation, the lower profile has a bottom wall 168, and opposing left and right sidewalls 170, 176. The left sidewall 170 forms an angled upper surface 172 with a lower surface 174 depending therefrom, and the right sidewall 176 forms an angled upper surface 178 with a lower surface 180 depending therefrom. The bottom wall 168 of the front portion 156 and rear portion 158 interfaces with the top surface 105 of the rail members 104, angled upper surface 172 interfaces with upper surface 108, and angled upper surface 178 interfaces with upper surface 114. In an implementation, a tooth 184 depends from the bottom wall 168 of the rear portion 158. The tooth 184 interfaces with a slot 120 formed by the rail 103 allowing the user to place the base 150 at various locations along the rail 103. As a result, the rail member 104 at either side of the slot 120 prevents the tooth 184, and thereby the base 150, from moving longitudinally along the length of the rail 103.

The lower portion of the left and right sidewalls 170, 176 form left and right notches 186, 188, accordingly, disposed between the front portion 156 and rear portion 158. The upper portion of the left and right sidewalls 170, 176 above the notches 186, 188 form the sidewalls to the passage 154 extending between the top surface 160 and bottom surface 162 of the base 150. The passage 154 is adapted to receive the upper portion 204 of the clamp 200, and the left and right notches 186, 188 provide room for the left and right legs 216, 218 of the clamp 200, accordingly.

The passage 154 and notches 186, 188 are formed to accommodate adjustments in position of the clamp 200 along the rail 103 when the clamp 200, base 150, and plate 250 are installed on the rail 103, allowing the bores 234, 236 to align with the bores 302, 304 of the sight 300.

Figure 6:
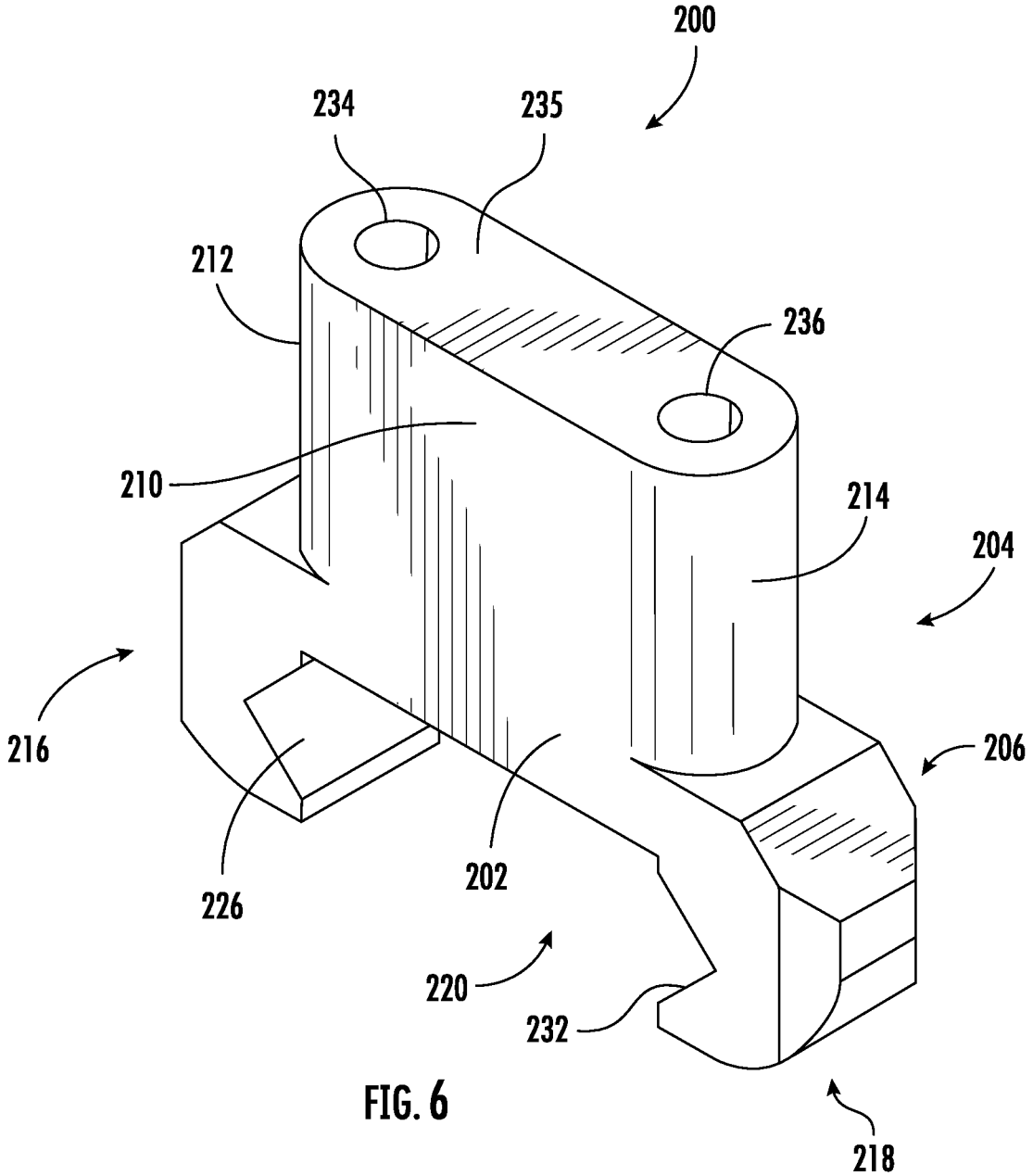
FIG. 6 is an isometric view from above of a clamp component of a modular firearm sight mounting system embodying principles of the disclosed subject matter.
Figure 7:
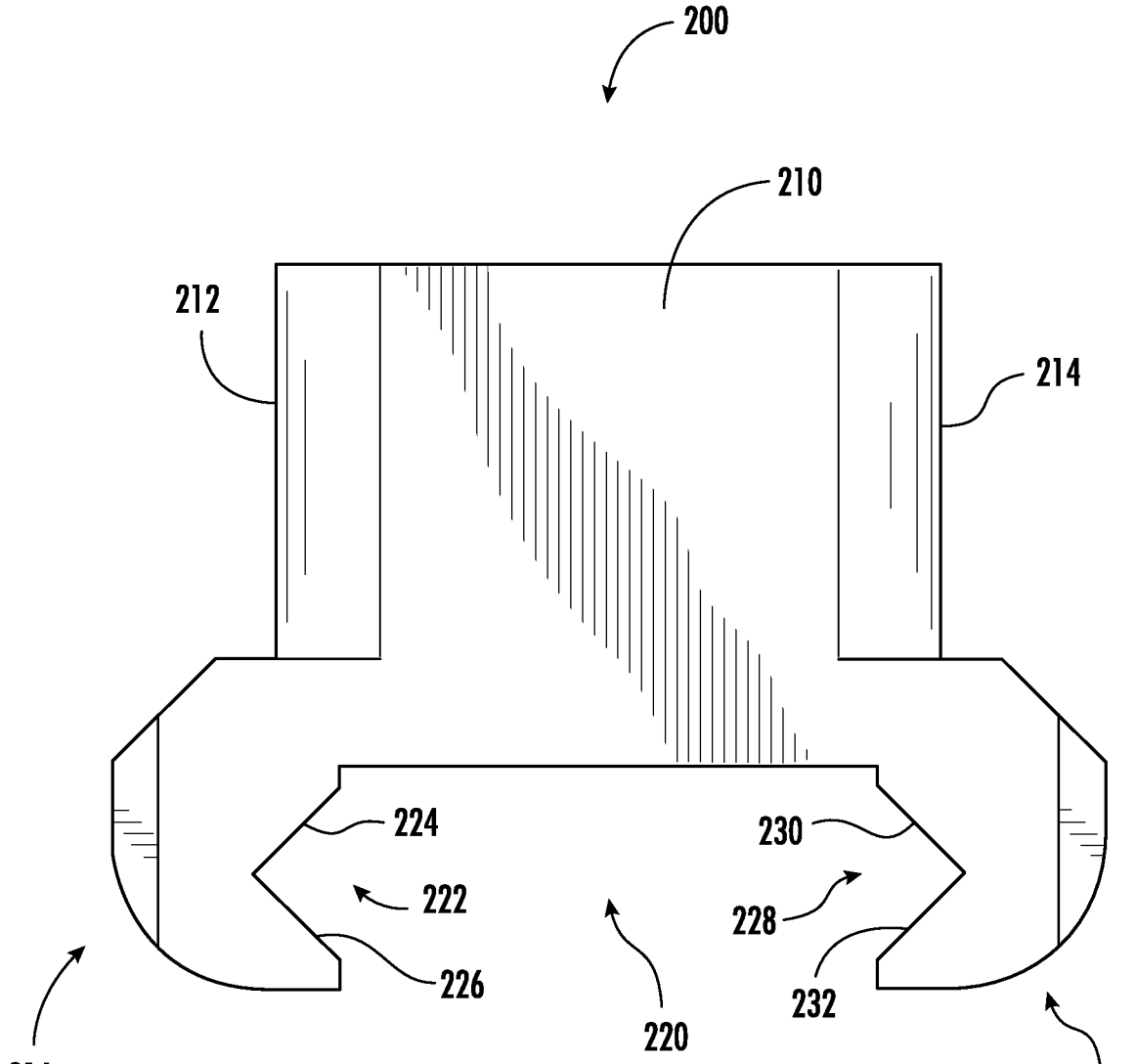
FIG. 7 is an elevation view of the component of FIG. 6.
Figure 8:
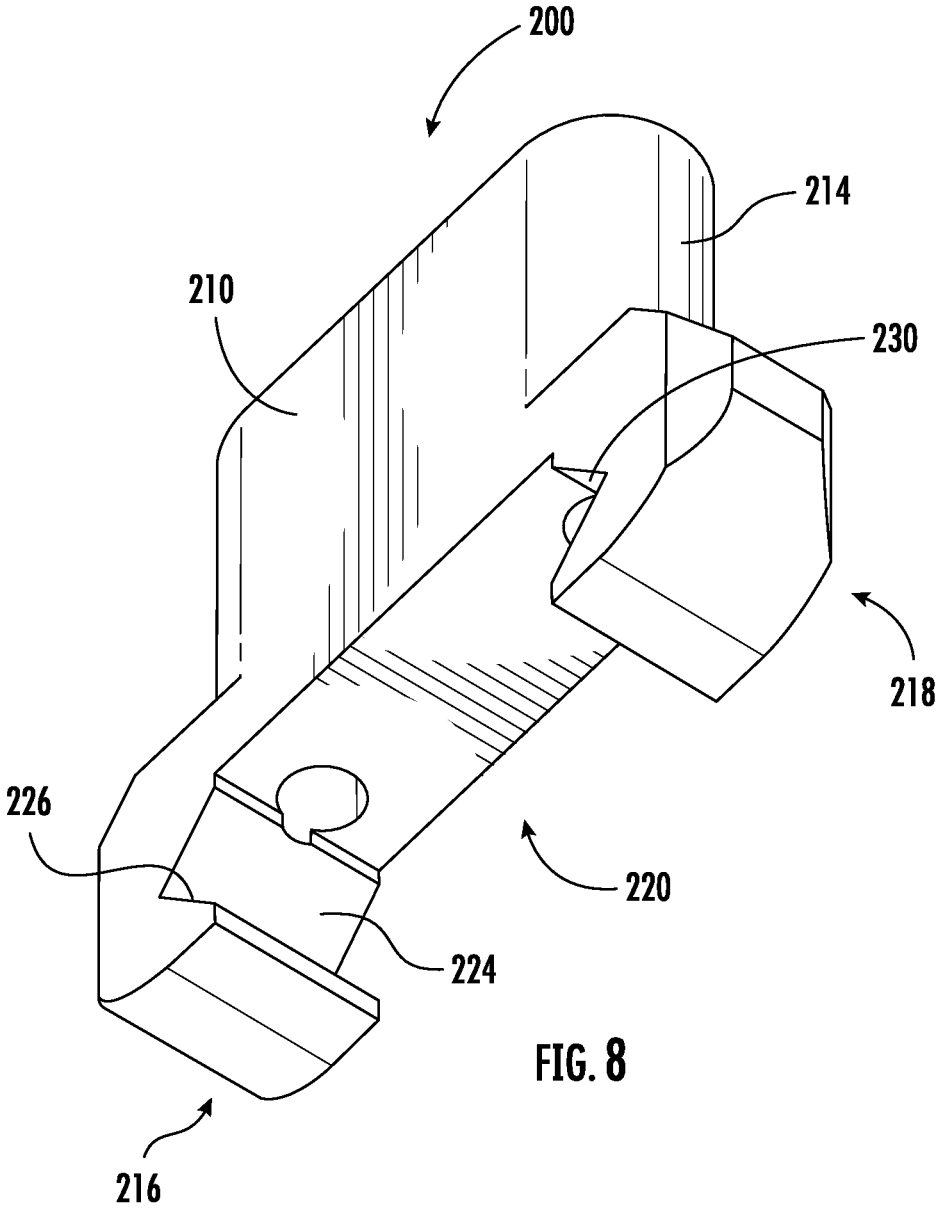
FIG. 8 is an isometric view from below of the component of FIG. 6.

Referring to FIGS. 6-8, the clamp 200 includes a body 202, forming an upper portion 204 and a lower portion 206, defining an overall height. The upper portion 204 extends upward from the lower portion 206 forming in general a column shape having a cross-section consisting of a rectangle with opposing front and rear faces 208, 210, defining a depth, and left and right semicircular ends 212, 214. At each end are threaded bores 234, 236 extending from the top surface 235 of the upper portion 204 into the upper portion 204 toward the lower portion 206 for receiving a threaded fastener 238.

In an implementation, the clamp 200 is manufactured from a resilient material, including metal such as 300 series stainless steel, or non-metal, and may be formed by casting or forming, reductive manufacturing such as milling, or additive manufacturing such as 3D printing or material deposition.

The lower portion 206 forms a rail cavity 220 in the form of a downwardly open polygonal cavity dimensioned to slidably receive the rail 103. The rail cavity 220 has left and right legs 216, 218, with opposing left and right faces 222, 228, accordingly, where the opposing faces slidably receive the corresponding left and right edges 106, 112 of the rail 103. In an implementation, the legs 216, 218 are fixed, or non-adjustable, therefore faces 222, 228 are a fixed distance apart, and dimensioned to slidably receive the rail 103. The left face 222 is formed by an upper surface 224 and lower surface 226, and the opposing right face 228 is formed by an upper surface 230 and lower surface 232.

Figure 9:
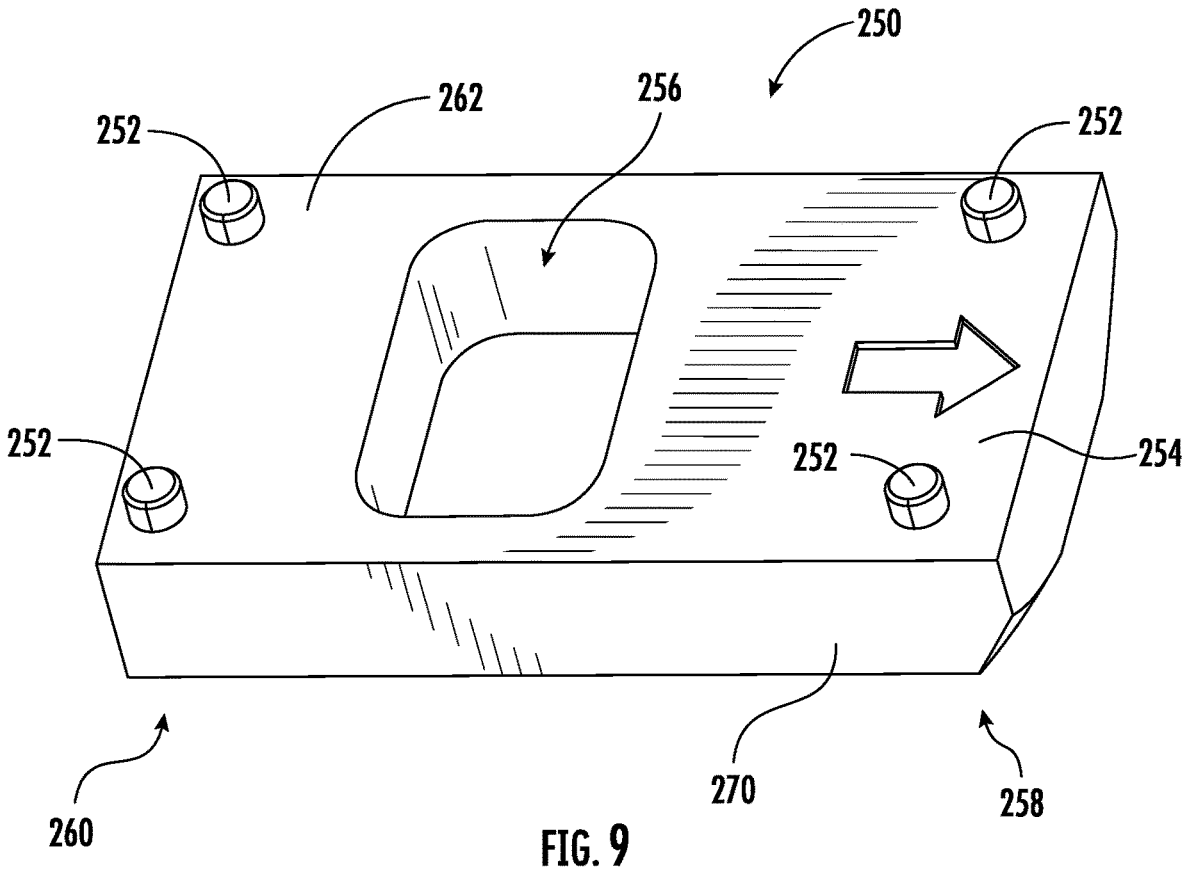
FIG. 9 is an isometric view from above of an adapter component of a modular firearm sight mounting system embodying principles of the disclosed subject matter.
Figure 10:
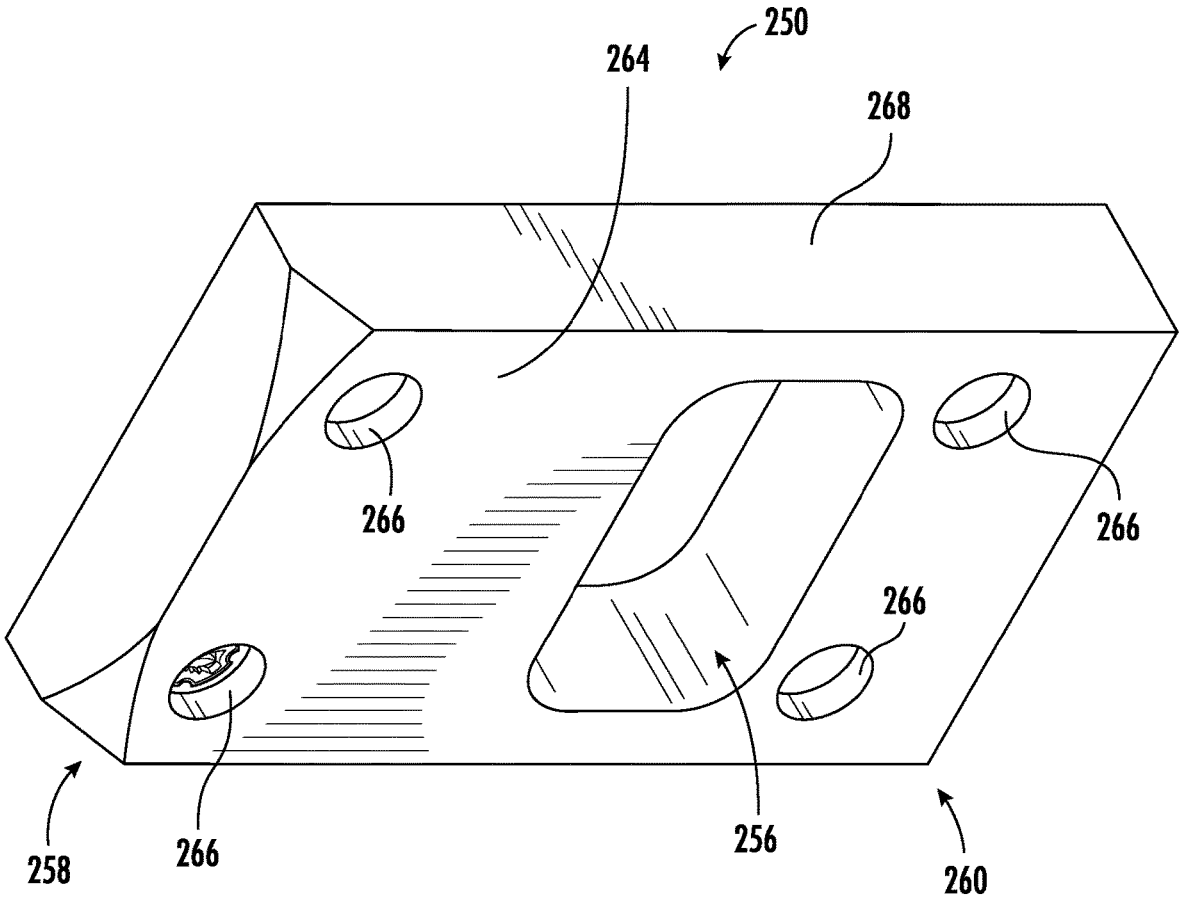
FIG. 10 is an isometric view from below of the component of FIG. 9.
Figure 11:
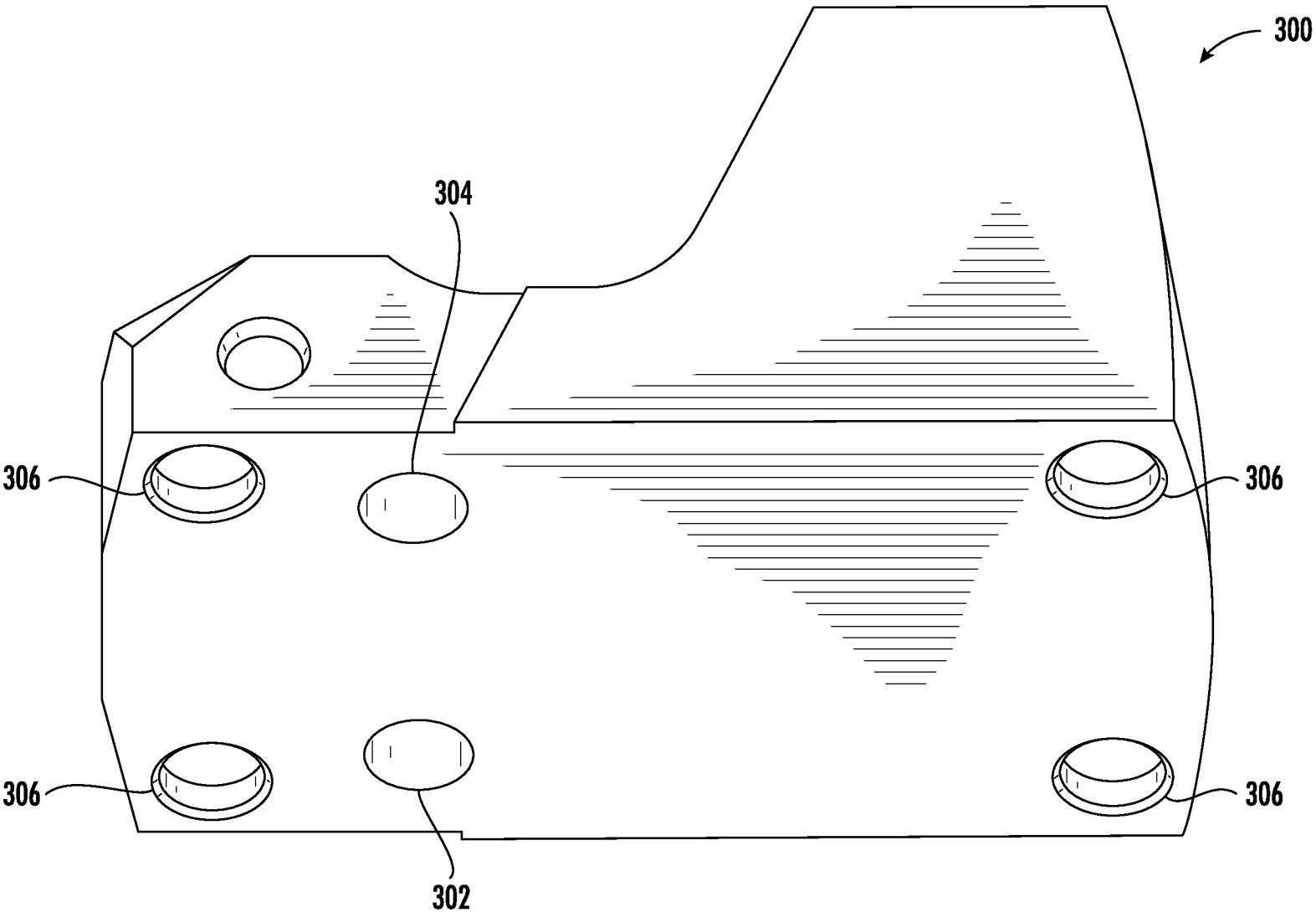
FIG. 11 is an isometric view from below of a firearm sight.
Figure 12:
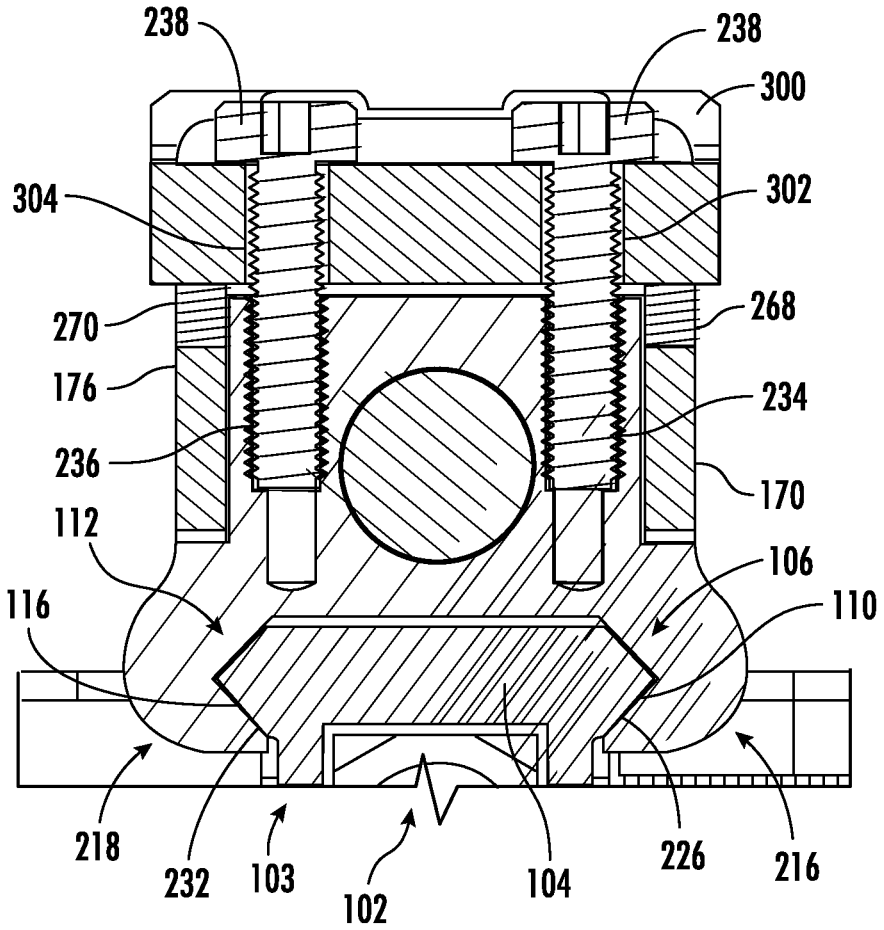
FIG. 12 is a section view of a modular firearm sight mounting system attached to a rail embodying principles of the disclosed subject matter.

Referring to FIGS. 9-10, the plate 250 has a body 254 extending between a front portion 258 and a rear portion 260, defining a length. A top surface 262 forms an arrangement of pins 252 extending therefrom, and a bottom surface 264 forms an arrangement of sockets 266 therein, defining a height. A passage 256 disposed between the front portion 258 and rear portion 260, and opposing left and right sides 268, 270, defining a width, extends between the top surface 262 and bottom surface 264, allowing passage of the clamp 200 upper portion 204 therein. The location of the pins 252 can be varied to form plates 250 to accommodate the location of the sockets 306 (FIG. 11) of sights 300 from third-party sight manufactures as various manufactures use different arrangements of sockets 306 on the bottom of their sights 300.

In an implementation, the plate 250 is manufactured from a resilient material, including metal or non-metal, such as nylon PA12, and may be formed by casting or forming, reductive manufacturing such as milling, or additive manufacturing such as 3D printing or material deposition. Accordingly, such manufacturing materials and methods allow the pins 252 to be formed by or molded into the plate 250.

The sight 300 is secured to the rail 103 by first sliding the T-shaped void of the lower portion 206 of the clamp 200 onto the T-shaped rail 103 via an end 130 of the rail 103. The clamp 200 is positioned along the rail 103 in the general location along the length of the rail 103 that the sight 300 is desired. Next, the base 150 is lowered onto the clamp 200, whereby the upper portion 204 of the clamp 200 is positioned within the passage 154, and the tooth is positioned within a slot 120 of the rail 103. As a result, the bottom surface 162 of the base 150 is supported at various points within the front portion 156 and rear portion 158 by rail members 104, and the left and right notches 186, 188 receive the left and right legs 216, 218. Next, an adapter plate 250 with the desired location and arrangement of pins 252 corresponding to the desired sight 300 is selected, and the plate 250 is lowered onto the top of the base 150 whereby the pins 161 of the base 150 engage the corresponding sockets 266 of the plate 250. The passage 256 of the plate 250 accommodates the upper portion 204 of the clamp 200. Next, the desired sight 300 is lowered onto the adapter plate 250 whereby the pins 252 engage the sockets 306 on the underside of the sight 300. The sight 300 includes attachment points or bores 302, 304 that align with the threaded bores 234, 236 of the clamp 200, and threaded fasteners 238 are threadably received within the bores 234, 236 for securing the sight 300 to the rail 103.

Tightening of the fasteners 238 pulls the clamp 200 toward the sight 300, and urges the sight 300, base 150, and adapter plate 250 toward the rail 103, tensioning the mount system 100. Tightening of the fasteners 238 engages the lower surface 226 of the of the left leg 216 with the continuous lower surface of the rail 103 and the upper surface 172 of the left sidewall 170 with an upper surface 108 of the rail 103, and also engages the lower surface 232 of the right leg 218 with the continuous lower surface of the rail 103 and the upper surface 178 of the right sidewall 176 with an upper surface 114 of the rail 103.

Certain terminology used in the description, and shown in the drawings, are not limiting. For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

It is to be understood that while certain aspects of the disclosed subject matter have been shown and described, the disclosed subject matter is not limited thereto and encompasses various other embodiments and aspects.

Although the subject matter has been disclosed with reference to various particular implementations, it is understood that equivalents may be employed, and substitutions made herein without departing from the scope of the disclosed subject matter as recited in the claims.

Having described the disclosed subject matter, what is claimed as new and desired to be secured by Letters Patent is:

1. A mounting system for securing a firearm sight to a firearm accessory rail, wherein the firearm accessory rail forms a lower surface, the mounting system comprising:

a clamp forming an upper portion and a lower portion, wherein the lower portion forms a downwardly open polygonal rail cavity;

a base engaging the firearm accessory rail, the base forming a passage therethrough;

wherein the base passage receives the clamp upper portion;

a plate forming a passage therethrough, wherein the plate is disposed between the base and the firearm sight;

wherein the firearm sight is secured to the clamp upper portion;

wherein the plate engages the base, and wherein the plate passage receives the clamp upper portion; and wherein securing the firearm sight to the clamp includes engaging the rail cavity with the lower surface of the rail.

2. The mounting system of claim 1, wherein the plate further comprises a pin that registers with a socket formed by the firearm sight.

3. The mounting system of claim 1, wherein the base further comprises a tooth depending therefrom, wherein the tooth is received by a slot formed by the rail.

4. The mounting system of claim 1, further comprising:

wherein the base includes notches formed by sidewalls.

5. A mounting system for securing a firearm sight to a firearm accessory rail, wherein the firearm accessory rail forms a lower surface, the mounting system comprising:

a clamp, comprising:

an upper portion; and a lower portion depending from the upper portion, the lower portion forming a downwardly open polygonal cavity for receiving the firearm accessory rail, the lower portion further comprising:

a left leg and opposing right leg, wherein the legs slidably receive the firearm accessory rail;

a base, comprising:

an upper surface;

a lower surface for engaging the firearm accessory rail; and a passage extending between the upper surface and lower surface, wherein the passage receives the clamp upper portion; and wherein the firearm sight is secured to the clamp upper portion;

a plate disposed between the base and the firearm sight, the plate further comprising:

an upper surface forming a pin, wherein the plate pin engages a socket formed by the firearm sight; and a passage extending between the upper surface and lower surface, wherein the passage receives the clamp upper portion; and wherein securing the firearm sight to the clamp further includes engaging each of the left leg and right leg with the rail lower surface.

6. The mounting system of claim 5, further comprising:

wherein the base upper surface forms a pin;

wherein the plate further comprises a lower surface forming a socket; and wherein the base pin engages the plate socket.

7. The mounting system of claim 5, further comprising:

wherein securing the firearm sight further includes engaging the base lower surface with the firearm accessory rail.

8. A mounting system for securing a firearm sight to a firearm accessory rail, wherein the firearm accessory rail forms a lower surface, the mounting system comprising:

a clamp defining a downwardly open polygonal rail cavity for receiving the firearm accessory rail;

a base, comprising:

a body defining a lower surface for engaging the firearm accessory rail; and a passage extending through the body, wherein the passage receives a portion of the clamp;

a plate disposed between the firearm sight and the base;

wherein the base forms a passage, and the passage receives a portion of the clamp; and wherein the firearm sight is secured to the clamp.

9. The mount system of claim 8, further comprising:

wherein the base includes a plurality of pins;

wherein the plate further comprises:

a plurality of pins; and a plurality of sockets for receiving the base pins; and wherein the firearm sight includes a plurality of sockets for receiving the plate pins.

10. The mount system of claim 8, further comprising:

wherein securing the firearm sight to the clamp secures the sight to the firearm accessory rail.

* * * * *